United States Patent [19]

Hurst

[11] Patent Number: 4,721,440

[45] Date of Patent: Jan. 26, 1988

[54] LINEAR GAS COMPRESSOR

[75] Inventor: Ralph Hurst, Clifton Park, N.Y.

[73] Assignee: Mechanical Technology Incorporated, Latham, N.Y.

[21] Appl. No.: 14,298

[22] Filed: Feb. 13, 1987

[51] Int. Cl.[4] ..... F04B 17/04; F04B 39/06

[52] U.S. Cl. ..... 417/371; 417/417; 92/163; 92/165 PR; 310/14; 310/30

[58] Field of Search ..... 417/416, 417, 366, 371, 417/418; 310/27; 92/163, 165 R, 165 PR, 169.3

[56] References Cited

U.S. PATENT DOCUMENTS 3,723,780 3/1973 Gillum ..... 310/27

3,781,140 12/1973 Gladden ..... 417/326

3,788,778 1/1974 Miller ..... 417/417

4,067,667 1/1978 White ..... 417/418

*Primary Examiner*—Leonard E. Smith

*Assistant Examiner*—Leonard P. Walnoha

*Attorney, Agent, or Firm*—Joseph V. Claeys; Joseph C. Sullivan

[57] ABSTRACT

A linear air compressor having a linear electrodynamic motor which is air cooled and has an increased stroke and accordingly increased output. The working piston is provided with and stroke parting on a push-pull spring provides for centering of the plunger of the motor.

9 Claims, 4 Drawing Figures

LINEAR GAS COMPRESSOR

FIELD OF THE INVENTION

The present invention relates to a compressor, which more particularly is a linear resonance air compressor.

BACKGROUND OF THE INVENTION

There exists a wide variety of compressors or pumps which utilize electrodynamic resonating motors. Usually what is involved is that a motor provides a driving force to a piston which provides the compression action on a working liquid or gas involved.

In this regard, such motors normally have a permanent magnet armature with a coil wound about a support and positioned within the field provided by the magnet. A compression piston is usually coupled to the armature and the armature held in a rest position by way of one or more main or resonance springs. When the coil is energized, a magnetic force is generated to drive the piston. The resonance spring causes the piston to oscillate back and forth to provide compression of the gas or liquid. Arrangements which operate in a manner such as this, or similar thereto, can be found in U.S. Pat. Nos. 3,814,550 issued June 4, 1974, 3,781,140 issued Dec. 25, 1973 and 3,325,085 issued June 13, 1967. These devices typically utilized circular type plungers which had certain disadvantages for which corrective measures were necessary.

Motors having flat type plungers are available. Such flat type plungers, while having certain advantages, particularly the reduction of weight, etc., have other disadvantages such as misalignment, undesired rotation, uncompensated temperature differential expansion, etc. Moreover, typical flat plunger designs are somewhat complicated and expensive.

There is known a linear electrodynamic motor having a flat plunger arrangement therein which involves the use of an electrodynamic linear motor for use in a variety of devices. The motor therein comprises a stack of flat magnetic members separated by insulated spacer members and held together by tie rods. The magnetic members are shaped as elongated flat laminated plates having at each end an enlarged opening to receive hollow guide rods thereby making up a basic plunger core assembly. A centered connecting rod is provided and coupled to a compression piston at one end. A centering or resonance spring may be provided at the opposite end, however due to the centering effect of the stator resulting from the magnetic driving force depending upon the application involved, the centering spring may be eliminated. The hollow guide rods are slideably mounted on respective bearing rods oppositely positioned and maintained by supporting arms. To a certain extent these arms are provided with an amount of flexure to allow for temperature expansion and contraction of the plunger assembly. The plunger core assembly is restricted to a reciprocal path guided by the guide or bearing rods, thereby advantageously maintaining the proper alignment of the plunger core during operation.

Positioned about and spaced from the plunger core is a stator assembly which is mounted to the housing. The application of current thereon causes a driving force on the plunger core which in turn drives the piston for compression of the working liquid. The piston is ported to regulate this stroke with the stator assembly and/or spring arrangement causing the plunger to oscillate in reciprocating motion.

The flat plunger configuration eliminates the flux return path which greatly reduces the plunger mass. The flat plunger is prevented from rotating due to the guide rods. Thus, by that arrangement an efficient motor is provided, which allows for a rugged compact design which is both efficient and durable, yet relatively inexpensive.

It has been found that many of the features in that arrangement are desirable in an arrangement involving a linear air compressor. It is therefor desirable to include such features and others in a linear air compressor, especially one of a relatively small size that has expanded output capacity, and which is efficient yet economic and durable.

SUMMARY OF THE INVENTION

It is therefor a principal object of the invention to provide for a linear air compressor which is relatively small, has an expanded output capacity, and which utilizes a flat plunger arrangement.

It is a further object to provide for such a compressor which operates efficiently, is durable and yet relatively simple in construction.

It is a further object to provide for such a compressor having an increased stroke, properly centered, utilizing midstroke porting and one which is effectively cooled and lubricated for efficient operation.

The present invention provides for a linear air compressor utilizing a flat plunger linear electrodynamic motor. The motor is coupled to a piston which reciprocates in a cylinder for compressor purposes as a result of the driving force on the plunger. The piston is a double acting piston which provides for compression on one side thereof and a gas spring on the other. The gas spring serves to increase the useful stroke of the piston thereby allowing an increased output capacity. A push-pull centering spring is coupled to the plunger and provides for centering startup in addition to having a construction which allows for efficient operating stress levels.

The piston is provided with mid-stroke porting which a stable dynamic mid-stroke operation of the motor plunger about a center line of stroke by equalizing the gas pressure between the gas spring and the compressor area.

In addition, the compressor is an oil-less arrangement which utilizes dry film bearings and the cooling thereof and other motor parts by way of the routing of intake gas over the motor coils and through hollow bearing rods supporting the plunger to the suction plenums.

BRIEF DESCRIPTION OF THE DRAWINGS

The aforenoted objects and advantages and others will be realized by the present invention, the description of which should be taken in conjunction with the drawings wherein.

DETAILED DESCRIPTION OF THE PREFERRED EMBODIMENT

Figure 1:
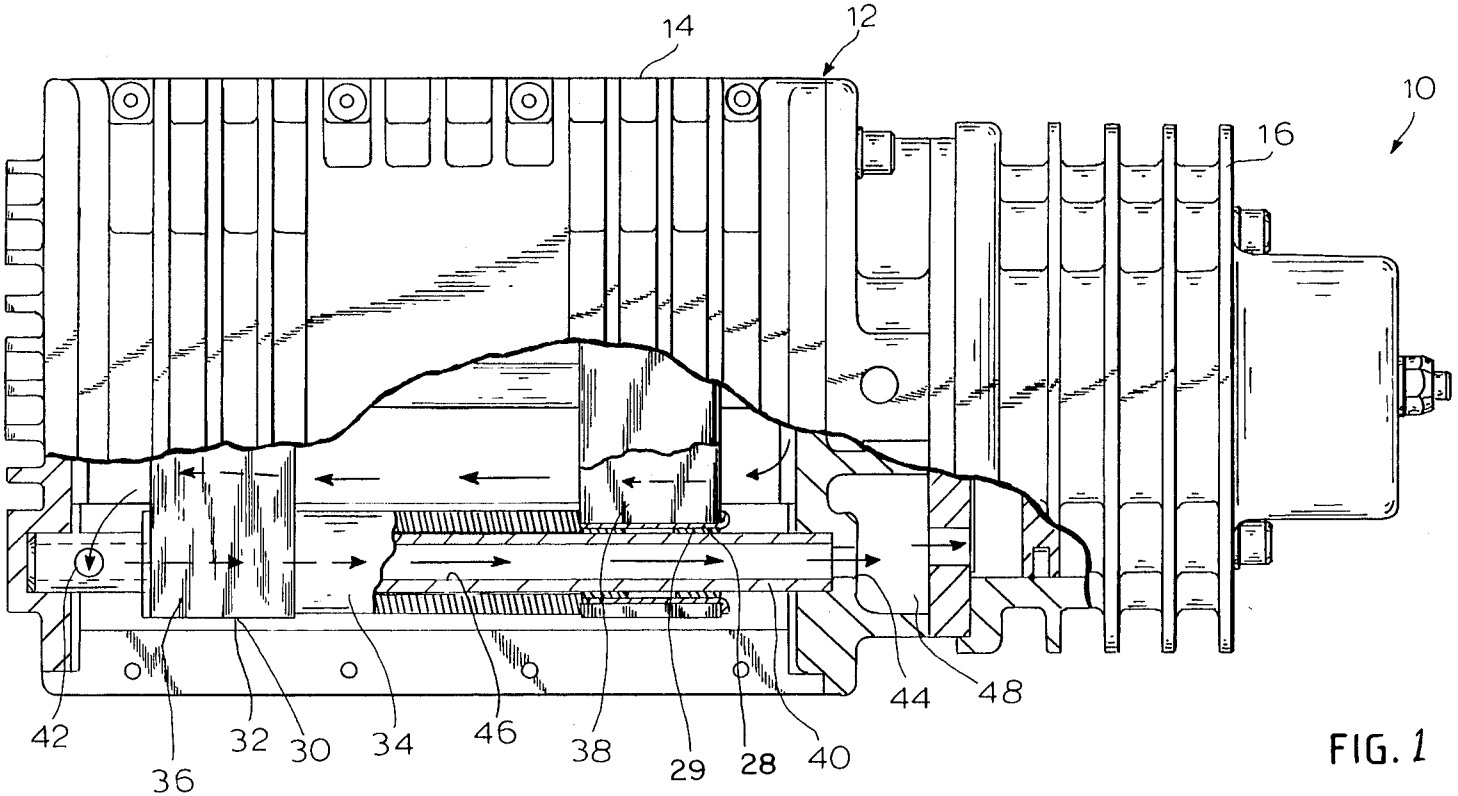
FIG. 1 is a top, partially sectional view of the linear compressor incorporating the teachings of the present invention.

Turning now more particularly to the drawings, there is shown a linear compressor 10 having an external housing 12 comprising a motor housing 14 and piston/spring housing 16. The motor housing 14 is somewhat rectangular in shape and includes an interior hollow area 18 which may generally conform to the shape of the linear motor 20.

Motor 20 is a flat plunger type and includes an upper and lower stator halves 22 and 24 between which is positioned a flat plunger arrangement 26. The stator halves 22 and 24 include respective AC coils 28 and DC coils 29.

The flat plunger assembly 26 basically comprises a plurality of alternating magnetic and insulating members 30 and 32 maintained on opposite hollow cylindrical tie rods 34. These magnetic and insulating members may be positioned in a layered fashion into two groups or pole packs 36 and 38. Appropriate insulation of the tie rods 34, mounting bolts, etc. (not shown) is utilized so that currents cannot set up and accumulate in the pole packs.

The tie rods 34 are reciprocally mounted on respective cylindrical hollow bearing members 40. These bearing members 40 include a dry film lubricant and have an inlet port 42 and outlet port 44 coupled to the bearings hollow interior surface 46. Inlet port 42 communicates with the interior area of the motor housing, with outlet port 44 being coupled to suction plenum 48. The ends of the bearing members 40 are shown supported by the motor housing 14.

The compressor 10 includes an air filter and noise suppressor 50 which include suction intakes 52 which communicate with interior 20 of the motor housing 14.

Figure 2:
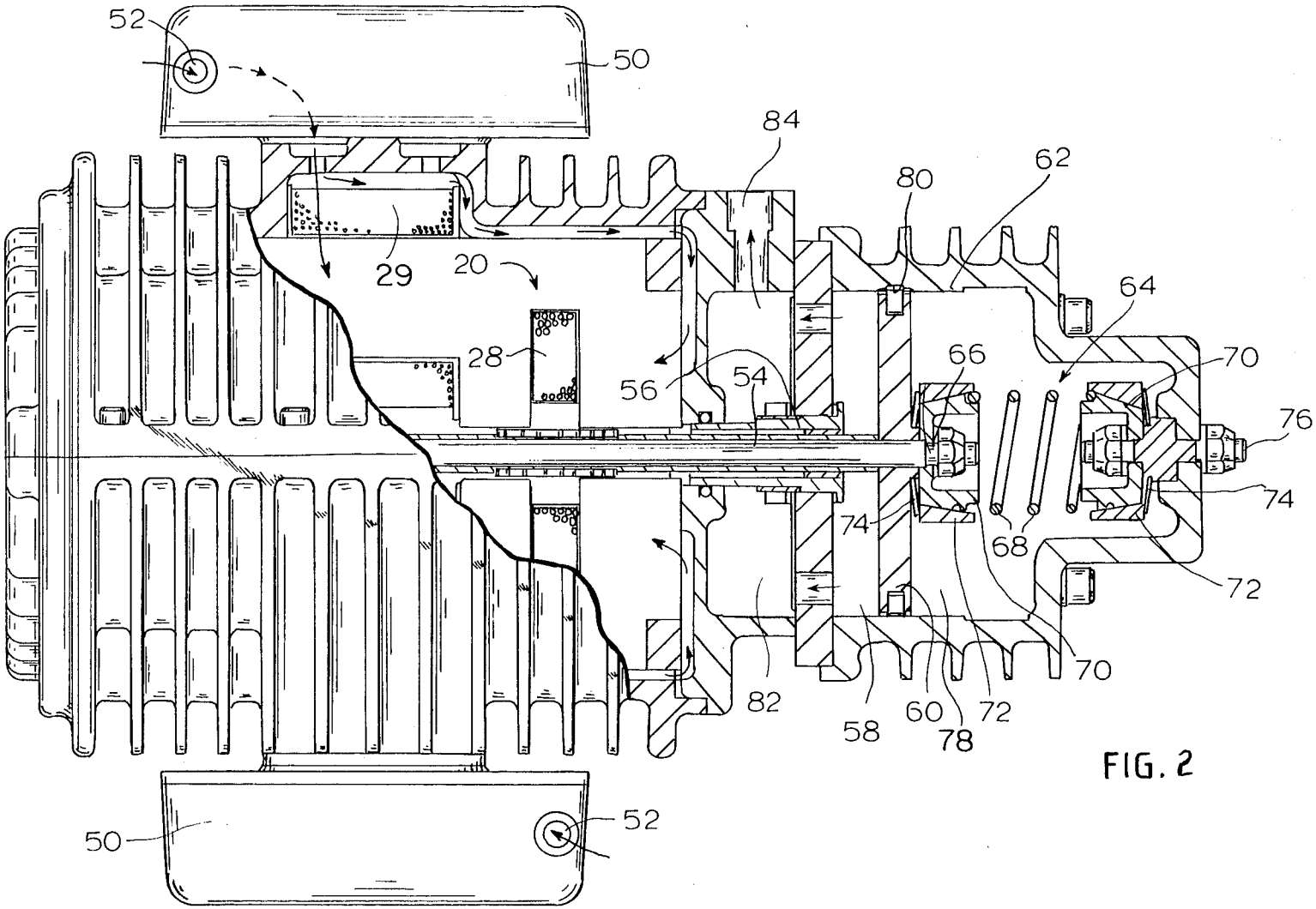
FIG. 2 is a side, partially sectional view of the linear compressor incorporating the teachings of the present invention.
Figure 4:
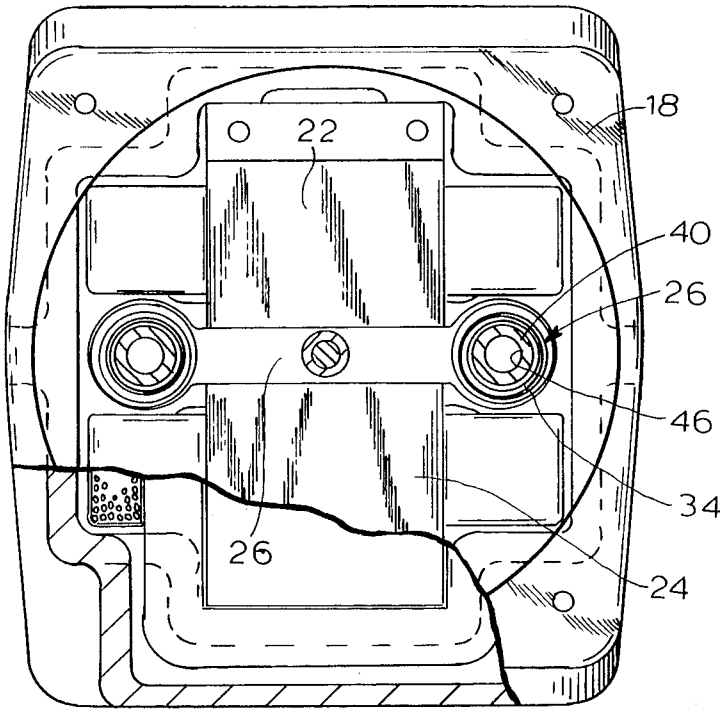
FIG. 4 is a sectional end view of the motor housing of the linear compressor.
Figure 3:
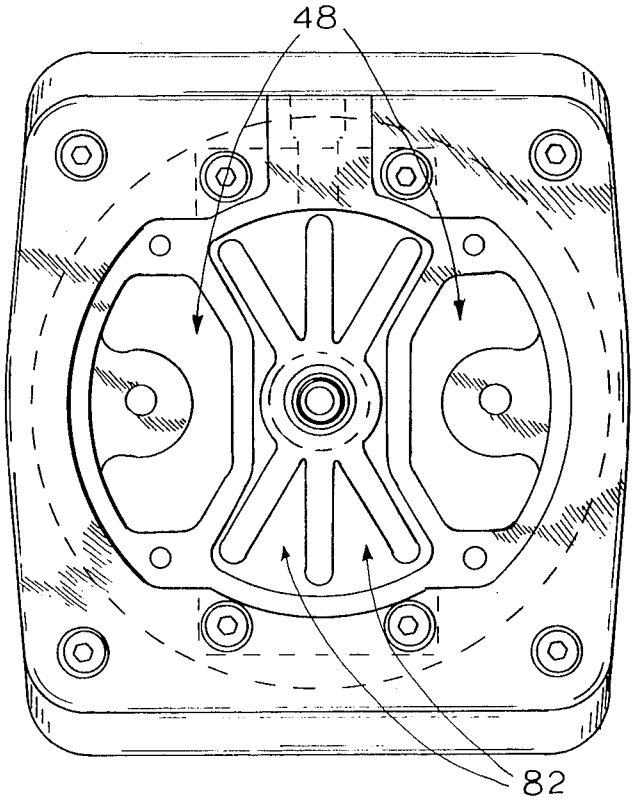
FIG. 3 is a section end view of the suction discharge plenums of the linear compressor.

Briefly, the operation of the compressor, air is sucked in through intakes 52 into the motor housing as indicated by the arrows in FIGS. 1 and 2. The route of this intake air is over and about the motor coils, inlet port 42, through the hollow interior 46 of bearing member 40 and outlet port 44 into the suction plenum 48. By such an arrangement, the intake air serves to cool the motor coils and the dry film bearing members 40 which results in an extension of their useful life.

Coupled to the plunger assembly is a piston rod 54 which may be affixed thereto as discussed in the aforenoted application or in any manner suitable for purpose. Movement of the plunger assembly results in a movement of the piston rod 54. Piston rod 54 passes through a bearing seal 56 which prevents the ingress and egress therethrough from the motor housing 14 and also provides a seal with respect to the compressor space 58.

The piston rod 54 is mechanically affixed to a piston 60 disposed in a hollow cylindrical cylinder 62 so that the movement of the piston rod 54 results in movement of the piston 60. Also affixed to rod 54 is a resonance spring assembly 64. The spring assembly 64 is utilized for plunger centering for start ups and for resonance purposes. In this regard, the end of rod 54 is mechanically affixed at 66 to the spring assembly 64. The spring assembly 64 is intended to utilize a helical high strength steel coil spring 68.

Note that when a spring is subject to high frequency oscillating displacement, fatigue is a problem. If the dynamic deflection range is small (of the order ½ inch or less), it is generally possible to use a conventional helical compression spring wherein the spring is preloaded between two plates. This results in the situation that the spring will always be in a state of compression as the relative displacements of the ends plates subjected the spring to the high-frequency oscillatory deflection. Preloaded compression arrangements are shown, for example, in U.S. Pat. Nos. 3,814,550 and 3,788,778. However, in preloaded compression arrangements there is no means required for mechanically gripping or clamping the ends of the spring coil. This arrangement cannot, by its nature, transmit tensile loading to a helical spring. Thus, if it is desired to subject a helical spring to tensile displacements, the preloaded compression spring arrangement is not sufficient.

As noted, helical compression springs should be limited to dynamic deflection ranges of ½ inch or less (for high strength steel springs) if very long operating life is required. Note, for any given spring material and operating frequency the dynamic deflection range will vary. However, if a helical spring is used as a tension-compression spring, such that one-half of the dynamic deflection range is achieved by compressive deflection and the other half by tensile deflection, the dynamic deflection range of the spring can be extended to approximately 1 inch. To achieve this extended deflection range, means must be provided for gripping the ends of the spring coil in such a way that (1) tensile deflections can be imparted to the spring, and (2) stress concentration effects arising from the gripping means are small.

The gripping arrangement attempts to simulate to a certain degree the method of stress transition which exists in a compression-only spring. With this gripping method, the spring can be operated as a tension-compression spring.

In this arrangement, the helical spring 68 is "threaded" onto a suitably machined mandrel block 70. The outside diameter of the spring is ground with a taper which matches the internal diameter taper of a clamping collar 72. The collar 72 is axially loaded against the ground outer diameter of the spring 68 by a suitable loading means such as, for example, a Belleville washer 74.

With this arrangement, there will be a differential strain between the surface of the stressed spring 68 and the essentially unstressed surface of the mandrel 70 against which the spring is seated. This differential strain is greatest at the point where the coil enters the mandrel thread and may result in surface fretting (wear) of the spring 68.

To alleviate the fretting wear problem, the spring 68 and/or the mandrel block 70 should be dip-coated in epoxy (or other low modulus material) to form a thin, low-modulus coating (a thickness of several mils may be sufficient) which can absorb the differential strains.

The opposite end of the spring is similarly affixed with the exception that the mandrel, collar and washer are held in place by way of a mounting bolt 76 axially centered with respect to the spring 68 mounting it to the cylindrical housing 62.

Turning now more particularly to the piston 60, it is a double acting piston which compresses on both sides of its face so that on the opposite side of the compression space 58 is a closed volume gas spring or balance chamber 78. A slot or channel 80 is provided in the cylinder wall which allows communication between the compression space 58 and chamber 78. Each time the piston 60 reciprocates at the point of channel 80 communication exists on both sides thereof so that there is a balancing of the average pressure point on each side of the piston which results in a zero or neutral pressure point position. By pushing the piston 60 in one direction creates a dynamic equilibrium force pushing it in the opposite direction. This results in having a compression cycle on one side and a gas spring effect on the other. The porting allows for an equal mean pressure on both sides of the piston at the zero or neutral position and enables the balancing and stabilizing space to develop a stabilizing gradient sufficient to keep the piston operating at a reasonably fixed mid-stroke position. Such a space provides for dynamic stiffness which serves to resonantly tune the device which is adjustable by adjusting the balancing chamber to achieve the dynamic tuning stiffness.

Turning now more particularly to the basic operation of the compressor, it is as follows. An alternative current is applied to the motor causing its magnetic plunger to drive a compression piston in a first direction compressing the gas or air. The current then alternates so that the plunger oscillates and returns to its center position due to the reversed driving force by the stator and/or the resonance spring assembly 64. During operation on one stroke, air is sucked in through the intake 52 around the motor 20 and through the dry film bearings 40 into the suction plenum 48 and in turn the compression space 58. On the reverse stroke, the air in the compression space 58 is forced out into a discharge plenum 82 and out a discharge outlet 84.

Accordingly, it is readily apparent that by the foregoing invention, its objects and advantages and others are realized and although a preferred embodiment has been disclosed and described in detail herein, its scope should not be limited thereby, rather, its scope should be determined in accordance with that of the appended claims.

What is claimed is:

1. A linear air compressor, comprising:

a motor housing having an internal area defining a closed volume;

a motor positioned within said motor housing;

intake means for allowing the ingress of air into the motor housing;

guide means comprising at least two guide shafts maintained at a spaced distance with respect to each other and supported in said housing;

said guide shafts having an inlet port communicating with the interior area of the motor housing and an outlet port providing an outlet for air from the interior area, wherein in operation of the compressor air passing between the intake means and outlet port passes through the interior area of the motor housing and through the guide shafts so as to cool said guide shafts;

plunger means supported by said guide means for reciprocal movement thereon within said housing and stator members supported in the housing and positioned above and below said plunger means; and wherein during the operation of said compressor said plunger means reciprocates on said guide means.

2. The invention in accordance with claim 1 wherein said guide means comprise a dry film bearing.

3. The invention in accordance with claim 1 wherein said outlet port communicates with a suction plenum for intaking of air during a stroke of the compressor.

4. The invention in accordance with claim 3 which includes a discharge plenum for discharging air; said suction and discharge plenum connecting with a piston means which is coupled to the plunger means, wherein the reciprocate movement of the plunger means causes a corresponding movement of the piston means causing an intake and discharge of air via said suction and discharge plenum respectively

5. The compressor in accordance with claim 4 wherein said piston is located in a cylindrical cylinder; said piston cylinder arrangement defining a compression chamber for compressing air and a closed volume balance chamber; porting means capable of coupling the balance chamber to the compression chamber during the reciprocation of the piston in the cylinder defining a neutral pressure point at which the piston is at equilibrium; and wherein the driving of the piston in one direction creates a dynamic equilibrium force in the opposite direction creating stabilizing space sufficient to keep the piston operating at a related fixed mid-stroke position.

6. The compressor in accordance with claim 5 which includes a spring assembly coupled to the plunger means, said spring means includes: a coil spring having its ends threaded on to respective mandrel blocks, hollow clamping collars positioned about said mandrel blocks for clamping the spring thereabout; said spring having an outer diameter at its ends which corresponds to the internal diameter of the clamping collars, and biasing means loading said clamping collar against the outer diameter of the spring ends.

7. The compressor in accordance with claim 6 wherein said biasing means is a spring washer.

8. The compressor in accordance with claim 7 which includes providing a low modulus coating between the surface of the spring and the mandrel blocks.

9. The compressor in accordance with claim 6 wherein said spring assembly is positioned in said balance chamber.

* * * * *

UNITED STATES PATENT AND TRADEMARK OFFICE

CERTIFICATE OF CORRECTION

PATENT NO. : 4,721,440

DATED : January 26, 1988

INVENTOR(S) : Ralph Hurst

It is certified that error appears in the above-identified patent and that said Letters Patent are hereby corrected as shown below:

Column 5, line 38, change "air" to --gas--;

line 42, change "air" to --gas--;

line 50, change "air" to --gas--;

line 52, change "air" to gas--;

Column 6, line 14, change "air" to --gas--;

line 16, change "air" to --gas--;

line 21, change "air" to --gas--;

line 26, change "air" to --gas--.

Signed and Sealed this

Second Day of August, 1988

*Attest:*

*Attesting Officer*

DONALD J. QUIGG

*Commissioner of Patents and Trademarks*